United States Patent [19]

Aquilina

[11] Patent Number: 4,891,908

[45] Date of Patent: Jan. 9, 1990

[54] PNEUMATIC DOOR OPENER

[76] Inventor: Anthony G. Aquilina, R.R. 5, Milton, Ontario, Canada, L9T 2X9

[21] Appl. No.: 271,621

[22] Filed: Nov. 15, 1988

Related U.S. Application Data

[63] Continuation-in-part of Ser. No. 29,733, Mar. 24, 1987, and a continuation-in-part of Ser. No. 216,879, Jul. 8, 1988.

[51] Int. Cl.[4] ..... E05F 15/00

[52] U.S. Cl. ..... 49/199; 49/357; 92/88

[58] Field of Search ..... 49/199, 200, 356; 160/188, 189; 92/88

[56] References Cited

U.S. PATENT DOCUMENTS 2,330,006 9/1943 Odenthal .
3,231,259 1/1966 Bobrowski .
3,319,303 5/1967 Salvo .
3,399,516 10/1967 Armstrong .
3,527,503 11/1970 Simmonds .
3,893,378 7/1975 Hewitt .
4,231,191 11/1980 Ellmore .
4,373,427 2/1983 Garlapaty et al. ..... 92/88
4,417,418 11/1983 Warning .
4,519,297 5/1985 Lipinski .

FOREIGN PATENT DOCUMENTS 7604919 11/1976 Netherlands .

OTHER PUBLICATIONS

Tol-O-Matic Product Advertisement.

*Primary Examiner*—Kenneth J. Dorner
*Assistant Examiner*—Gerald A. Anderson
*Attorney, Agent, or Firm*—Fay, Sharpe, Beall, Fagan, Minnich & McKee

[57] ABSTRACT

A door operator system includes a rodless fluid cylinder that has a cylinder body and a rodless piston adapted for reciprocation in the cylinder body. A carriage which is adapted for reciprocation externally along the length of the cylinder body is secured to the piston. An arm member connects the cylinder carriage to an associated sliding door. A control circuit is provided for controlling the operation of the fluid cylinder and hence the position of the associated sliding door.

21 Claims, 5 Drawing Sheets

PNEUMATIC DOOR OPENER

BACKGROUND OF THE INVENTION

The present application is a continuation-in-part of application Ser. No. 029,733, filed on Mar. 24, 1987, and still pending. The present application is also a continuation-in-part of application Ser. No. 216,879, filed on July 8, 1988, and still pending.

This invention generally pertains to a pneumatic door operator construction. More specifically, the present invention relates to a sliding door operator system which utilizes a rodless fluid cylinder for mechanically opening and closing a door.

The invention is particularly applicable to sectional overhead doors of the multiple panel type and will be described with particular reference thereto. However, it will be appreciated by those skilled in the art that the invention has broader applications and may also be adapted for use in many other environments such as single panel overhead doors and even sideward sliding doors or the like.

Most overhead doors are counterbalanced with a torsion spring or a counterweight system for storing energy during door closing so that energy may be extracted during door opening. During opening, most of the energy for lifting such a door is derived from the energy stored in the spring or counterweight system. If the door is counterbalanced fairly well, the amount of manual energy required to open the door need only be sufficient to make up the frictional and other losses in the system. During door closing, the energy required is that for making up the frictional and other losses since most of the energy which is transferred to the spring or counterweight storage system is derived from the weight of the descending door.

In general, conventional overhead doors of this nature are actuated by a cable which is wound around a drum axially driven by the torsion spring with the drum being rotated by a chain driven sprocket. Generally, the chain is driven by an electric motor. In some environments, however, the use of electrical motors is undesirable because of the possible danger of a spark causing an explosion or a fire. It has also been found that electric motors are disadvantageous since, if the door becomes jammed, the motor will continue rotating and will likely unwind the cable between the drum and the door and this could prove hazardous to personnel and may damage property.

Also, when such doors go through a high number of cycles, such as in a car wash or the like, the chains, sprockets, electrical motors, and bearings wear out at a fairly rapid rate and this results in frequent breakdowns of the door opening mechanism. Moreover, malfunctions of the door opening mechanism can sometimes also lead to damage to the upper portion of the door which can be fairly expensive to repair.

Electrically powered door operators are generally controlled by the use of limit switches. These limit switches are interposed on the door operator at locations which correspond to the fully opened and fully closed positions of the door. However, the operator itself is longer than the length of travel of the carriage which is secured to a chain that is moved by the electric motor between the limit switches. Therefore, when either of the limit switches fails, the carriage, and hence the door, can keep going in the door open or door closed direction with adverse consequences. If the limit switch for door closing fails, the door keeps going and slams into the floor of the building thereby causing damage to the door. In the door open direction, a failure of the limit switch will cause the door to continue to travel and may break the chain of the operator or the cable between the drum and the door. Failure of limit switches has also led to a burn out of the electric motor of the operator. Clutch disks are sometimes used to mitigate the effect of limit switch failure on such operators. However, these clutch disks do not work in high humidity environments, such as car washes, or underground parking garages, since the clutch disk will seize after a period of time.

One recent suggestion has been to utilize a pair of pneumatic cylinders in a side mounted operator for moving the chain of a chain driven door operator thereby rotating a sprocket mounted on the main door shaft. However, side mounted operators are not recommended when a trolley operator could be used in their place since with a side mounted operator, any hesitation in the door travel results in an unwinding of the cable from the torsion bar drum which makes the door liable to a free fall that could cause grave injury to people as well as damage to objects under the door and to the door itself. The pneumatic cylinder actuated side mounted operator mechanism is also disadvantageous since chains and sprockets, which undergo a high number of cycles, wear out at a relatively rapid rate resulting in frequent breakdowns of the door operator mechanism and, sometimes, damage to the door.

Accordingly, it has been considered desirable to develop a new and improved door operator system which would overcome the foregoing difficulties and others while providing better and more advantageous overall results.

BRIEF SUMMARY OF THE INVENTION

In accordance with the present invention, a new and improved sliding door operator system is provided More particularly in accordance with this aspect of the invention, the system comprises a rodless fluid cylinder including a cylinder body and a rodless piston adapted for reciprocation in the cylinder body. A carriage is adapted for reciprocation externally along the length of the cylinder body with the carriage being secured to the piston. A link means is provided for connecting the cylinder to an associated sliding door. A control means is provided for controlling the operation of the fluid cylinder and hence, the position of the associated sliding door. The control means comprises a source of pressurized fluid and a directional valve communicating with the fluid cylinder for directing a pressurized fluid from the source of pressurized fluid to a respective end of the fluid cylinder. An exhaust line communicates with the fluid cylinder for venting an exhaust fluid from the fluid cylinder. A back pressure relief valve is in fluid communication with the exhaust line for regulating a flow of the exhaust fluid through the exhaust line.

According to another aspect of the present invention, an air powered sliding door operator system is provided.

According to this aspect of the invention, the system comprises a door which is mounted for sliding movement between a first position in which it closes a building opening and a second position spaced away from the opening. A rodless air cylinder is provided comprising a cylinder body, a rodless piston adapted for reciprocation in the cylinder body, and a carriage adapted for reciprocation externally along the length of the cylinder body. The carriage is secured to the piston. A shock absorbing connecting means connects the cylinder carriage to the slding door. The connecting means comprises a pair of telescoping tubular sections, a first of which is pivotally secured to the fluid cylinder carriage by a first bracket and a second of which is pivotally secured to the sliding door by a second bracket. An adjusting means is provided for selectively adjusting an overall length of the pair of telescoping tubular sections. A fastener means secures the pair of telescoping tubular sections to each other at a selected overall length. Also provided is a valve means for selectively feeding pressurized air to the air cylinder to drive the rodless, piston and hence, the carriage, thereby moving the door between the first and second positions thereof.

According to a further aspect of the invention, a fluid powered operator system is provided for an articulated overhead sliding door that is movable in guideways which extend upwardly alongside an opening for the door and then rearwardly.

More particularly in accordance with this aspect of the invention, the system comprises a fluid cylinder comprising an elongated cylinder body, a rodless piston adapted for longitudinal reciprocation in the cylinder body, and a carriage adapted for reciprocation externally along the length of the cylinder. The carriage is secured to the piston. An arm member connects the cylinder carriage to the door. The arm member comprises two telescoping portions and a resilient means for resiliently biasing the two telescoping portions in relation to each other. An adjustment means is provided for selectively adjusting an overall length of the two telescoping portions. A source of pressurized fluid actuates a movement of the rodless piston in the fluid cylinder. A first valve means is interposed between the source of pressurized fluid and the fluid cylinder for selectively feeding pressurized fluid to the fluid cylinder to reciprocate the rodless piston therein.

One advantage of the present invention is the provision of a new door operator system for sliding doors.

Another advantage of the present invention is the provision of a door operator system which actuates a door by the movement of a rodless piston which reciprocates in a cylinder.

Still another advantage of the present invention is the provision of a door operator system which can actuate most types of overhead doors that have a counterbalance means and can also actuate selected sideward sliding doors.

Yet another advantage of the present invention is the provision of a trolley-type door operator system which does away with chains, sprockets, bearings, and motors, all of which are prone to frequent breakdowns when exposed to high numbers of cycles.

A further advantage of the present invention is the provision of a door operator system which opens and closes a door with a minimum of force thereby preventing injury to persons or damage to objects which are inadvertently left in the path of the door when the door is being moved.

A still further advantage of the present invention is the provision of a door operator system having an elongated front mounting pad which correctly spaces a front end of a rodless fluid cylinder from the door so that the fluid cylinder can be cushioned in its last few inches of travel in both the door opening and door closing directions.

A yet further advantage of the present invention is the provision of a door operator system which is provided with an adjustable arm that enables the system to be adapted for use with various types and sizes of doors. The arm is preferably resiliently biased in order to lessen shocks both on the door and on the rodless fluid cylinder.

An additional advantage of the present invention is the provision of a valving system for a pressurized fluid actuated door operator system. The valving system includes a means for controlling the flow of inlet fluid and exhaust fluid from a fluid cylinder of the door operator.

Yet still another advantage of the present invention is the provision of a valving systems for a pressurized fluid actuated door operator which includes a means for controlling the sped with which the door moves.

Still other advantages and benefits of the present invention will become apparent to those skilled in the art upon reading and understanding the following detailed specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENT

Figure 1:
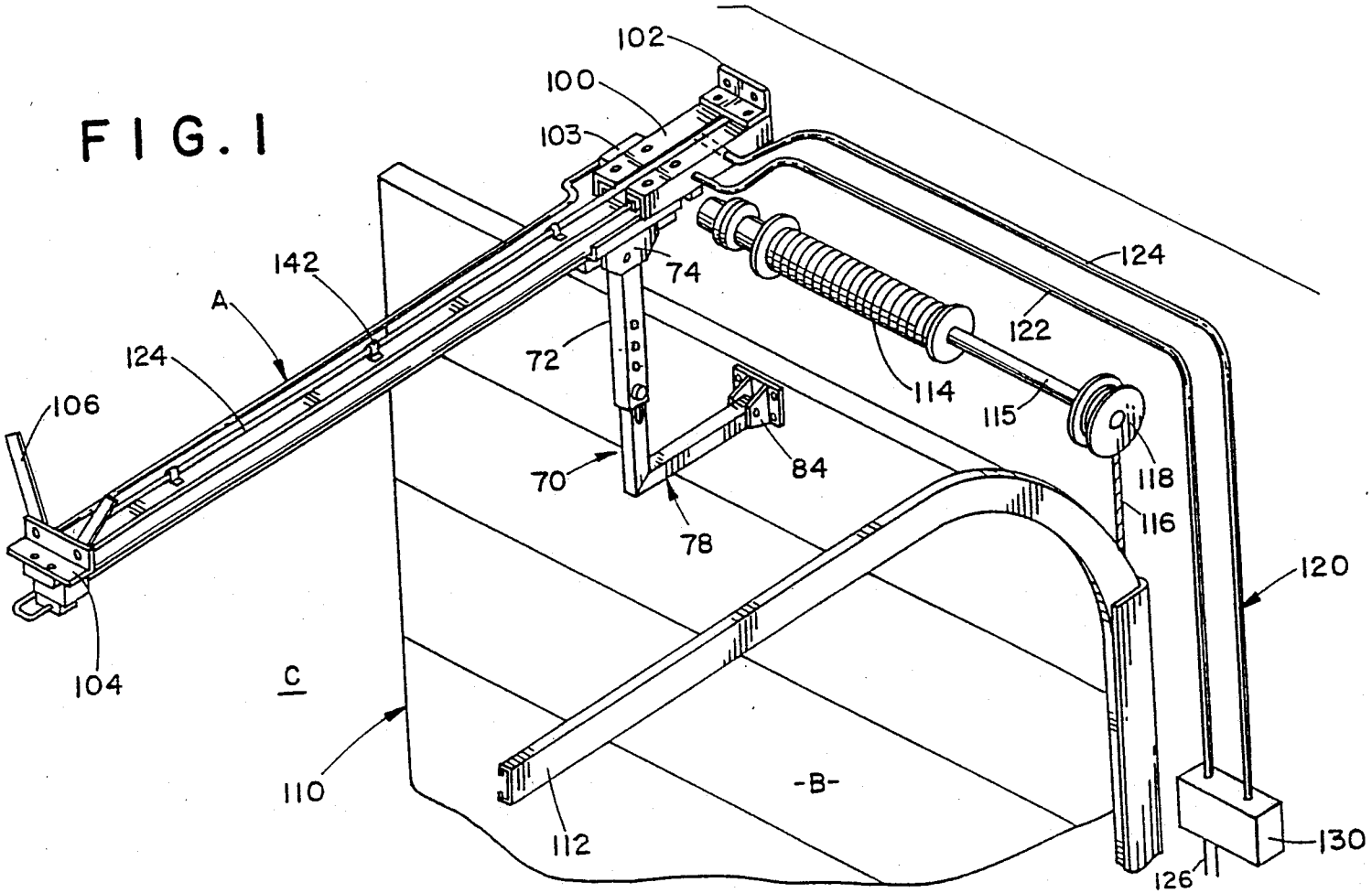
FIG. 1 is a perspective view of the door operator system according to the present invention in conjunction with a door of a building.

Referring now to the drawings wherein the showings are for purposes of illustrating a preferred embodiment of the invention only and not for purposes of limiting same, FIG. 1 shows the subject new door operator system A as it is utilized on a door B which closes an opening in a building C. While the door operator is primarily designed for and will hereinafter be described in connection with a sectional overhead sliding door, it should be appreciated that the overall inventive concept involved could be adapted for use in many other overhead and sideward sliding door environments as well.

Figure 3:
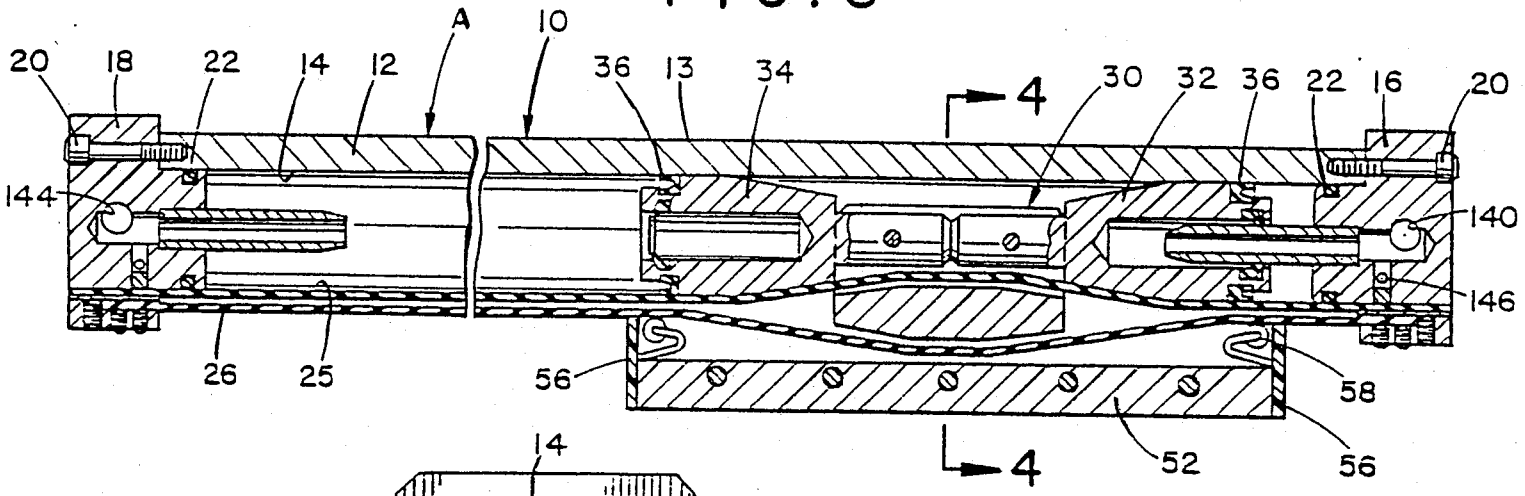
FIG. 3 is an enlarged side elevational view, partially in cross-section, of the cylinder of FIG. 1.

With reference now to FIG. 3, the operator system A includes a cylinder member 10 which comprises a tubular body 12 that has an outer periphery 13 having two spaced substantially square sides and two spaced rounded sides (as is more evident from FIG. 4) and a longitudinal bore 14 extending therethrough. A first end of the bore is closed by a first end cap member 16 with a second, and opposite, end of the bore 14 being closed by a second end cap member 18. Suitable fasteners 20 secure the first and second end caps 16, 18 to the tubular body 12. A suitable seal means 22 is provided for each of the end caps 16, 18 to prevent pressurized air from leaking therethrough.

Figure 4:
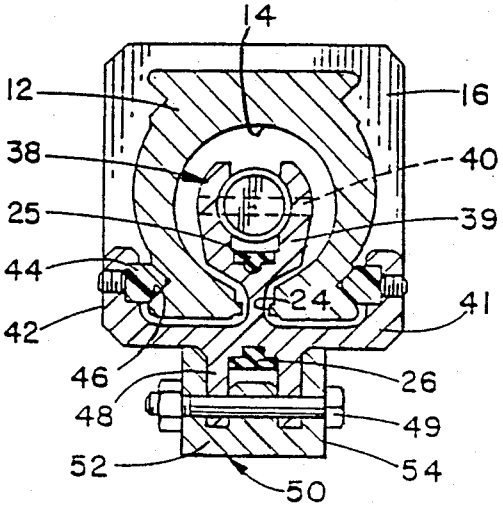
FIG. 4 is an end elevational view in cross-section of the cylinder of FIG. 3.

As shown in FIG. 4, a slot 24 extends longitudinally along one of the square sides of the tubular body 12 to communicate the bore 14 with the environment. A pair of spaced sealing bands or strips 25, 26 seal the slot to isolate the bore 14 and prevent pressurized fluid from leaking out therethrough. The bands are secured to the two end caps 16, 18.

Adapted to reciprocate longitudinally in the bore 14 of the cylinder is a piston body 30 which is comprised of a pair of identical and opposing sections 32, 34 which are joined together in a suitable conventional manner. A seal means 36 extends peripherally around each section 32, 34 of the piston to provide a seal between the piston section and the cylinder bore 14.

A piston bracket 38 (FIG. 4) is secured at a yokelike section 39 by suitable conventional fasteners 40 to the first and second sections 32, 34 and is adapted to extend through the cylinder slot 24. A section 41 of the bracket 38 is positioned outwardly of the tubular body 12 and extends along substantially one face thereof as is illustrated best in FIG. 4. It can be seen in this FIGURE that the bracket 38 is somewhat T-shaped with the section 41 of the T extending outside of the cylinder tubular body 12. This outer section 41 has depending sides 42 to each of which is secured an inwardly extending bearing rod 44. The bearing rods slide in suitably configured grooves 46 formed in the outer periphery 13 of the tubular body so as to allow a smooth sliding motion of the piston bracket 38 as the piston moves. This system allows the cylinder 10 to withstand high axial and radial loads and moments while eliminating the requirement for external guides and supports.

Secured to a pair of spaced depending flanges 48 of the piston bracket 38 by suitable conventional fasteners 49 is a carriage 50. The carriage has a base wall 52, a pair of side walls 54, and a pair of opposing end walls 56. Seal means 58 in the form of wiper seals are provided on the end walls 56 of the carriage and act to clean the second seal band 26 of the cylinder.

Figure 2:
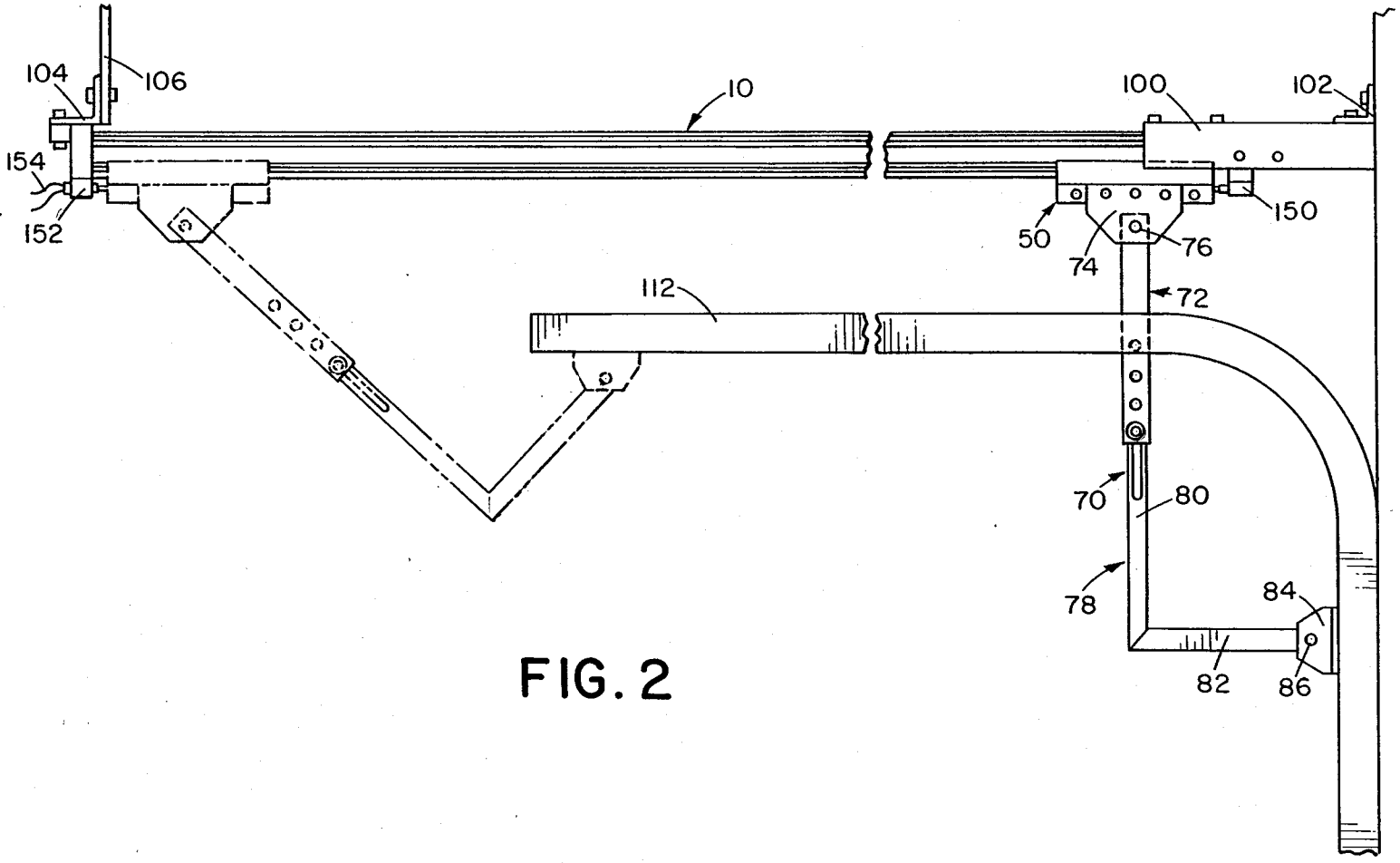
FIG. 2 is a side elevational view of the door operator system of FIG. 1.

With reference now to FIG. 2, a shock absorbing connecting means such as an arm means 70 is secured to the carriage 50 in suitable conventional manner. The arm means, which can have any suitable desired shape, includes first tubular arm member 72 which is secured by a bracket 74 to the carriage 50. Preferably, a fastener 76 which enables a pivoting motion of the arm member 72 with respect to the bracket 74 is provided for securing the arm member to the bracket.

A second arm member 78, having a first section 80 and a second section 82, which is disposed at an approximately 90° angle to the first section, is also provided. The second arm member 78 is secured to a bracket 84 by a suitable fastener 86. The bracket 84 is in turn secured to the door B as shown in FIG. 1. Preferably, the fastener 86 enables a pivoting motion of the second arm member 78 with respect to the bracket 84.

Figure 2B:
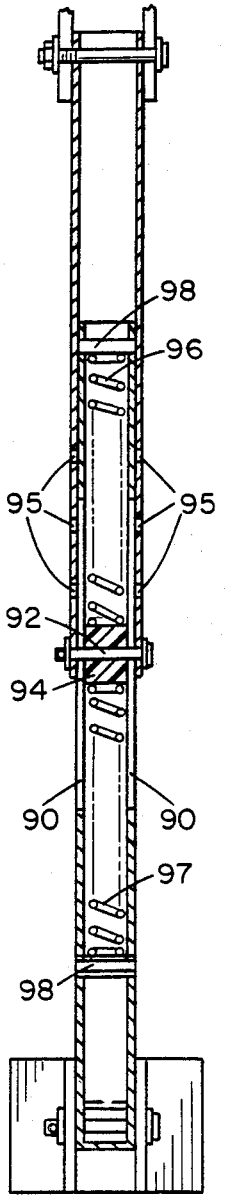
FIG. 2B is a cross sectional view of the arm member of FIG. 2A along line 2B—2B.
Figure 2A:
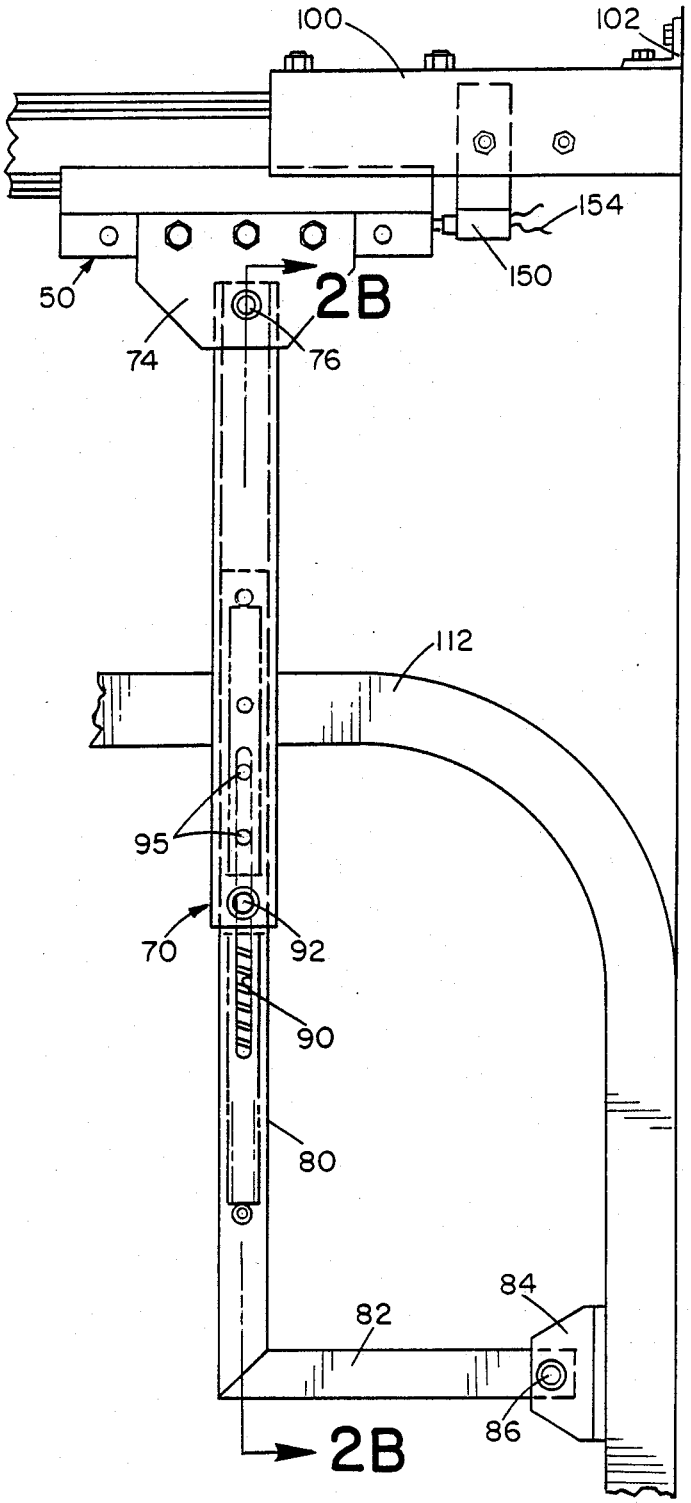
FIG. 2A is an enlarged side elevational view, partially in cross-section, of an arm member of the door operator system of FIG. 2.

With reference now to FIG. 2A, a slot 90 is shown as extending horizontally along a portion of the lower arm first section 80. There are actually two such slots, but only one of these is visible in FIG. 2A. A clevis pin 92 extends outwardly through both slots 90. As is shown in FIG. 2B, the clevis pin extends entirely through the lower arm first section 80 and out both sides thereof. The clevis pin extends through a slide block 94 which is preferably made of a plastic material and is slidably positioned inside the lower arm first section 80. The plastic block 94 is adapted to slide in the arm section 80 as permitted by the sliding slots 90. A plurality of sets of adjusting holes 95 are provided on the upper arm 72 and the clevis pin 92 also extends through one set of these. In this way, the clevis pin forms a securing means for securing the upper and lower arms 72, 78 to each other in an adjustable manner. In other words, by utilizing different ones of the plurality of adjusting holes 95, the entire arm assembly or arm means 70 can be given different lengths to adjust the arm for a particular door environment.

A pair of springs 96, 97 are also provided within the lower arm first section 80. The two springs are positioned on opposing sides of the plastic slide block as is illustrated in FIG. 2B. Each spring is held in place by a respective spring stop 98 which is fastened to the lower arm first section 80. In this way, the telescoping movement of the upper arm 72 in relation to the lower arm 74 is resiliently biased to a center position. For this purpose, the two springs 96, 97 are preferably compression springs.

It is noted that the provision of the slots 90 in the lower arm first section 80 provides a limit means for the telescoping action of the upper arm in relation to the lower arm.

The arm means 70 also acts as a shock absorber during movement of the door B because of the positioning of the pair of compression springs 96, 97 to regulate the telescoping action of the pair of arm members 72, 78. As is evident from the dotted lines of FIG. 2, the arm means 70 pivots in relation to both the door B and the cylinder 10 during travel of the door from the closed position to the open position.

With reference again to FIG. 1, a mounting pad 100 is secured to a first end of the cylinder 10 with a front mounting bracket 102 securing the mounting pad and hence the cylinder to a suitable wall of the building C. The mounting pad 100 is so sized in length as to correctly locate the fluid cylinder first end from the wall surface so that the door will be closed when the rodless fluid cylinder carriage is at a first end and the door will be completely open when the carriage is at a second end. Additionally, the mounting pad is so sized that the last few inches of travel of the door in either direction will be cushioned. Secured to the mounting pad is an electrical junction box 103. A rear mounting bracket 104 is secured to the cylinder and a pair of hangers 106 are fastened to the mounting bracket and to the adjacent ceiling (not illustrated).

Preferably, the door B includes a door member 110 which can be made of a plurality of articulated longitudinally extending slats or planks. The door is adapted to slide up and down on a pair of spaced tracks 112, only one of which is illustrated in FIG. 1. In general, doors of this nature conventionally include a counterbalancing means such as an axial torsion spring 114 which is secured above the door B. Cooperating with the torsion spring through a bar 115 is a cable 116 which is secured on a first end to the door B (not visible in FIG. 1) and wound at its second end on a drum 118 axially driven by the torsion spring.

In order to actuate the cylinder 10, a pressurized fluid circuit 120, preferably pneumatic, is provided. The circuit includes a first conduit 122 and a second conduit 124 each of which is in fluid communication with a respective end of the cylinder through the cylinder end caps 16, 18. A source of pressurized fluid, such as a compressor, is in fluid communication with a respective one of the conduits 122, 124 through an inlet pipe 126 as directed by a control means 130. The control means can be in the form of a valve control which is interposed between the conduits 122, 124 and the inlet pipe 126 in order to control the movement of the rodless piston in the cylinder.

With reference again now also to FIG. 3, a bore 140 in the first end cap 16 enables pressurized fluid from the first conduit 122 to enter one end of the cylinder behind the piston first section 32 to urge the piston 30 toward the second end cap 18 of the cylinder. The second conduit 124 extends longitudinally down the cylinder 10 and is secured thereto by suitable hose clamps 142 as shown in FIG. 1. The second conduit 124 communicates through a bore 144 in the second end cap 18 with the second end of the cylinder. A suitable conventional adjustable valve means such as a needle valve, of which a bore 146 is illustrated, can be provided in each end cap 16, 18 to cushion the movement of the piston 30 adjacent the two ends of the cylinder.

As shown in FIG. 2, if desired, suitable conventional micro switches 150, 152 can be secured to the end caps 16, 18 to activate additional electronic functions in conjunction with the opening and closing of the door if desired. As is well known in the art, such additional electronic functions can include the deactivation of a conventional contact strip (not illustrated) at the bottom of the door (which normally will stop or reverse the movement of the door upon impact with an object) when the door is within a few inches of the floor, and a conventional timer (not illustrated) which can be tripped upon door opening to being door closing after, for example, 30 seconds of door open time. The micro switches 150, 152 are connected to the control means 130 by suitable wiring 154. Alternatively, proximity switches can be utilized at the ends of the cylinder. Also, conventional magnetic reed switches could be positioned alongside the cylinder for position sensing of the piston between the ends of the cylinder.

Figure 5:
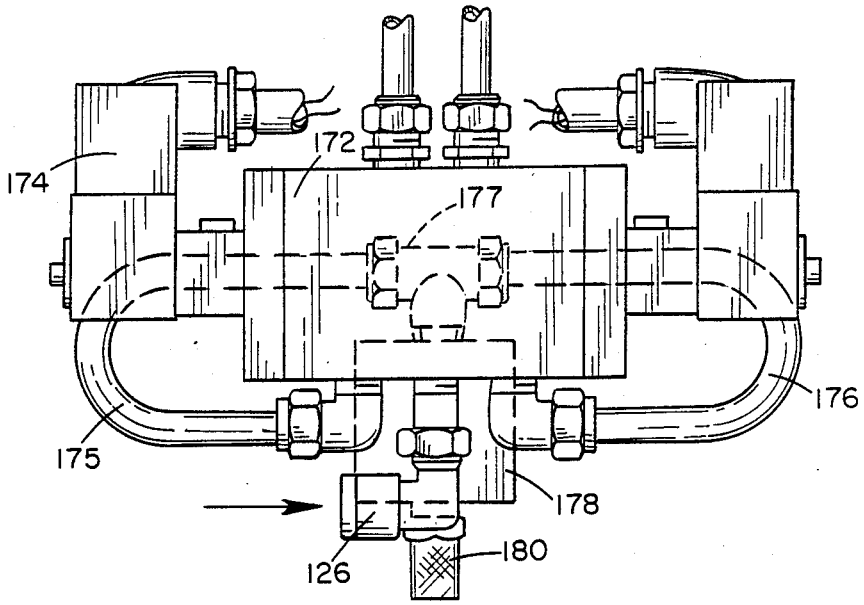
FIG. 5 is a front elevational view of a control means for the operator of FIG. 1; and, FIG. 6 is a side elevational view of the control means of FIG. 5.

With reference now to FIG. 5, the control means 130 can include a valve housing 172 which holds a conventional three position four way valve with open, stop, and close functions or a conventional two position four way valve with only open and close functions (not visible). Of course, it should be recognized that a wide variety of other types of valves could also be employed in the control means as the specific door application requires. Whatever type of valve is used, it can be controlled by conventional solenoids 174, as is illustrated in FIG. 5, or by the other conventional means known in the art.

Figure 6:
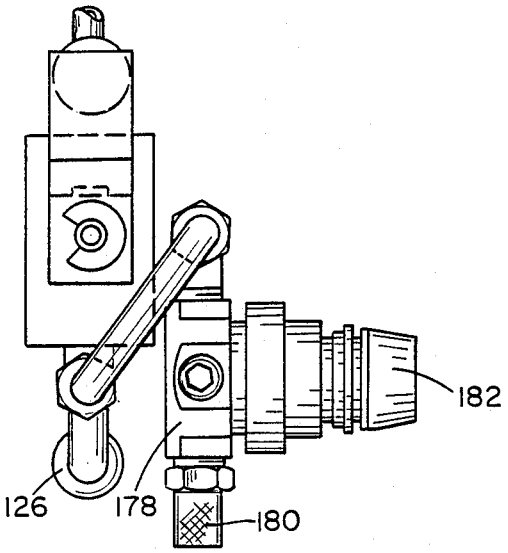

The control means 130 can, as is illustrated in FIGS. 5 and 6, also include a pair of exhaust lines 175, 176, extending from the valve housing 172 which are joined by a T-fitting 177 and vent through an adjustment assembly 178 including a conventional pressure relief valve (not visible) held in a housing, and a muffler 180 in fluid communication with the relief valve, to the atmosphere. The exhaust assembly provides a pressure relief on both exhaust ports and will maintain a back pressure when the door is held in a mid-travel position. The pressure relief valve will dump a certain amount of exhaust unless it receives pressure from the other side of the piston. Therefore, back pressure on the piston will, to some extent, balance the forward pressure on the piston and reduce the tendency of the door, when stopped in midtravel, to creep up or down as dictated by whichever side of the piston has the higher pressure on it.

An adjustment knob 182 is provided on the assembly 178 in order to regulate the rate at which the exhaust is vented to the atmosphere by the pressure relief valve thus providing a means for controlling the speed with which the piston will travel. In other words, the adjustment knob will enable one to adjust the rate with which the pressure relief valve will vent pressurized fluid from the exhaust conduits 175, 176 and thereby control the speed of piston travel.

The pressure relief valve, which may for the sake of quiet operation, be of the diaphragm type, as is conventionally known, can be set to vent fluid which is at a pressure of greater than a predetermined amount. If desired, this vent pressure can be the fluid inlet pressure minus, for example, 20 psi. In this way, when the piston is moving, exhaust fluid pressure can be vented but when piston movement stops, a substantial amount of pressure is maintained on the face of the piston opposite to the direction of motion.

When a pressurized fluid such as a compressed air or another suitable compressed gas is supplied by the pressurized fluid source 126 and the control means 130 is actuated to a door open position, the rodless piston 30 and its attached carriage 50 will be urged by pressurized air flowing through the first end cap 16 to move from a front end of the cylinder 10 towards a rear end thereof. At this time, the air supply port 144 and the second conduit 124 act as an exhaust means for exhausting air from a section of the cylinder between the second section 34 and the end cap 18 through the control means 130 to the environment. The carriage 50 thus moves pulling the door B with it, thereby opening the door. The piston 30 slows down a few inches before contacting the cylinder body second end cap 18, the speed of movement of the piston 30 adjacent the end caps 16, 18 can be regulated by means of the adjustable valve means. Generally, the piston's speed of movement can be regulated through the pressure relief valve 178.

The piston 30, and hence the carriage 50 remains under pressure while the door B is in the Open position until the control means 130 receives a signal electrically or manually to shift to another position.

When the valve 130 shifts to the closing direction, the bore or port 144 in the rear end cap 18 becomes the fluid support while the bore or port 140 in the front end cap 16 becomes the exhaust port. Therefore, the speed with which the door closes can be different from the speed with which the door opens. In some cases, for example in automated car washes, the door B requires a rapid opening cycle. This can be regulated by the adjustable valve means such as by adjusting the speed control knob 182 on the back pressure relief valve 178 of the control means 130. An additional conventional quick exhaust valve (not illustrated) can also be provided to regulate speed in one direction if desired. On the other hand, for safety reasons, the closing cycle should be at normal speed, which is, at a maximum, approximately 1 second per foot as is recommended by the Canadian Door Institute.

However, the door's speed could be set to slow, normal, or rapid speed to suit the particular door application involved. This setting can be done through an adjustment in the air flow and by restricting exhaust. To stop the door at any intermediate position, one merely needs to change the three position control valve to a neutral or stop position in which it will block the flow of pressurized air to either end of the cylinder 10. Creep is prevented in the intermediate door position by the provision of the valve 172. Also, the motion of the door can instantly be reversed by having the directional valve shift from one direction to the other. This can be done either manually or electrically depending upon the type of controls used.

Since the cylinder 10 operates on a low volume of pressurized gas or air, the cylinder does not move with enough force to cause damage to the door. More importantly, the door does not move with enough force to cause damage to objects or be hazardous to personnel.

When the cylinder 10 reaches the end of its stroke, the door will be in a closed position and will be locked automatically without any additional locking mechanism being necessary since the arm means 70 will be located at a 90° angle to the door B as is indicated in FIGS. 1 and 2. Thus, if the door were attempted to be forced open, the arm means 70 would simply be shoved upwardly against the cylinder 10 and the door would not open.

The cylinder 10, carriage 50, and end caps 16, 18 can all be made from any suitable conventional material such as anodized aluminum. The piston 30 and the piston bracket 38 can be made from a suitable conventional material such as aluminum or steel. The sealing bands 25, 26 can be made from a high density oil-resistant plastic, or another suitable material and the various seals can be made from Buna N or another suitable rubber. One such suitable cylinder assembly is sold by the Norgren Martonair Co. under the designation LINTRA C/45000.

The present invention thus provides a door operator system which minimizes frequent breakdowns, hazard to personnel, and damage to the door or objects which might be in the way of the door. Such a door operator is also believed to have a greatly improved life cycle in relation to the conventional electrically driven chain trolley door operators.

The invention has been described with reference to a preferred embodiment. Obviously, modifications and alterations will occur to others upon the reading and understanding of this specification. It is intended to include all such modifications and alterations insofar as they come within the scope of the appended claims or the equivalents thereof.

Having thus described the preferred embodiment, the invention is now claimed to be:

1. A sliding door operator system comprising:

a rodless fluid cylinder comprising a cylinder body, a rodless piston adapted for reciprocation in said cylinder body, and a carriage adapted for reciprocation externally along the length of said cylinder body, said carriage being secured to said piston;

a link means for connecting said cylinder carriage to an associated sliding door;

a control means for controlling the operation of said fluid cylinder, and hence the position of the associated sliding door, wherein said control means comprises:

a source of pressurized fluid, a directional valve communicating with said fluid cylinder for directing a pressurized fluid from said source of pressurized fluid to a respective end of said fluid cylinder, an exhaust line communicating with said fluid cylinder for venting an exhaust fluid from said fluid cylinder, and a back pressure relief valve in fluid communication with said exhaust line for regulating a flow of said exhaust fluid through said exhaust line.

2. The system of claim 1 further comprising a switch means located at each end of said cylinder, each said switch means being in electrical contact with said control means whereby said control means can activate an associated electrical component when said switch means is tripped by contact with sad rodless fluid cylinder carriage.

3. The system of claim 1 wherein said link means comprises:

a pair of telescoping tubular sections, a first of said sections being secured to said fluid cylinder carriage and a second of said sections being secured to the associated sliding door;

a resilient means for cushioning the telescoping action of said pair of tubular sections; and, a limit means for limiting the telescoping action of said pair of tubular sections.

4. The system of claim 2 further comprising:

a bracket means for securing a first and a second end of said fluid cylinder to an adjacent wall, said bracket means comprising:

an elongated mounting pad secured on a first end to the fluid cylinder first end and secured on a second end to an inside wall surface of an opening covered by the associated sliding door, and, at least one hanger secured at a first end to said fluid cylinder second end and at a second end to a second inside wall surface; and, a pair of fluid lines each of which communicates with a respective end of said cylinder, at least one of said lines being partly housed in said mounting pad.

5. The assembly of claim 4 wherein said directional valve is located in said control panel for directing pressurized fluid from said source of pressurized fluid to one of said fluid lines, and wherein first and second exhaust lines are provided for communicating with said directional valve to vent exhaust fluid from said fluid cylinder.

6. The assembly of claim 5 wherein said control means further comprises a muffler in fluid communication with said back pressure relief valve, wherein said exhaust fluid is vented to the environment through said muffler.

7. The assembly of claim 6 wherein said control means further comprises a speed control adjustment knob.

8. The system of claim 4 further comprising an electrical junction box which houses electrical lines communicating with said switch means, said junction box being secured to said mounting pad.

9. The system of claim 4 further comprising at least one clip for securing one of said pair of fluid lines to said cylinder such that said one fluid line communicates with said fluid cylinder second end.

10. An air powered sliding door operator system comprising:

a door which is mounted for sliding movement between a first position in which it closes a building opening and a second position spaced away from the opening;

a rodless air cylinder comprising a cylinder body, a rodless piston adapted for reciprocation in said cylinder body, and a carriage adapted for reciprocation externally along the length of said cylinder body, said carriage being secured to said piston;

shock absorbing connecting means for connecting said cylinder carriage to said sliding door wherein said shock absorbing connecting means comprises:

a pair of telescoping tubular sections, a first of said sections being pivotally secured to said fluid cylinder carriage by a first bracket and a second of said sections being pivotally secured to said sliding door by a second bracket, an adjustment means for selectively adjusting an overall length of said pair of telescoping tubular sections, and, a fastener means for securing said pair of telescoping tubular sections to each other, at a selected overall length; and, valve means for selectively feeding pressurized air to said air cylinder to drive said rodless piston and hence said carriage thereby moving said door between said first and second positions thereof.

11. The system of claim 10 wherein the door is an overhead door and further comprising:

a counterbalance means for counterbalancing the weight of said door;

a guideway means in which said door is movable;

guides secured to said door, said guides engaging rideway means; and, wherein a longitudinal axis of said air cylinder is approximately parallel to a longitudinal axis of an upper section of said guideway means.

12. The system of claim 10 wherein said shock absorbing connecting means further comprises:

a spring positioned in one of said tubular sections for cushioning the telescoping action of the other of said tubular sections; and, a limit means for limiting the telescoping action of the other of said tubular sections.

13. The system of claim 12 wherein said shock absorbing connecting means further comprises:

a sliding block member through which said fastener means extends; and, a pair of spaced spring stop members, one located on either side of said sliding block member, wherein both said sliding block member and said spring stop members are positioned inside a first one of said tubular sections and wherein two springs are provided in an end to end relationship in said first tubular section between said pair of spring stop members and separated by said sliding block member.

14. The system of claim 13 wherein said first tubular section further includes a pair of aligned longitudinally extending slots provided on opposing wall surfaces of a first tubular section, and wherein said fastener means extends through said pair of slots.

15. The system of claim 14 wherein said adjustment means for said pair of tubular sections comprises a plurality of pairs of spaced apertures provided in a second of said tubular sections, and wherein said fastener means extends through a selected one of said pairs of apertures to secure said second tubular section to said first tubular section.

16. A fluid powered operator system for an articulated overhead sliding door that is movable in guideways which extend upwardly alongside an opening for the door and then rearwardly, comprising:

a fluid cylinder comprising an elongated cylinder body, a rodless piston adapted for longitudinal reciprocation in said cylinder body, and a carriage adapted for reciprocation externally along the length of said cylinder body, said carriage being secured to said piston;

an arm member which connects said cylinder carriage to the door wherein said arm member comprises:

two telescoping portions, a resilient means for resiliently biasing said two telescoping portions in relation to each other, and, an adjustment means for selectively adjusting an overall length of said two telescoping portions;

a source of pressurized fluid for activating a movement of said rodless piston in said fluid cylinder; and, first valve means interposed between said source of pressurized fluid and said fluid cylinder for selectively feeding pressurized fluid to said fluid cylinder to reciprocate said rodless piston therein.

17. The system of claim 16 wherein said first valve means comprises:

a directional valve; and, a solenoid means for actuating said directional valve.

18. The system of claim 16 further comprising a second valve means for controlling a flow of fluid out of said fluid cylinder, said second valve means being in fluid communication with said first valve means and comprising:

first and second exhaust lines;

a back pressure relief valve in fluid communication with said first and second exhaust lines; and, a control means for controlling the operation of said back pressure relief valve.

19. The system of claim 16 further comprising a fastener means for securing said two telescoping portions to each other at a selected overall length.

20. The system of claim 19 further comprising a limit means for limiting a telescoping action of said two telescoping portions in relation to each other.

21. The system of claim 16 wherein said arm member comprises:

a first tubular section which comprises a first of said two arm portions and is straight and is pivotally secured at a first end by a first pivot means and a first bracket to said air cylinder carriage; and, a second tubular section which comprises a second of said two arm portions, a first end of said second section being received in a second end of said first section in a telescoping manner, said second section being pivotally secured at a second end thereof by a second pivot means and a second bracket to the door.

* * * * *